US005133398A

United States Patent [19]

Yang et al.

[11] Patent Number: 5,133,398

[45] Date of Patent: Jul. 28, 1992

[54] SHUTTER ASSEMBLY

[76] Inventors: Anthony Yang; Victor Yang, both of 1594 Travois Cir., Las Vegas, Nev. 89119

[21] Appl. No.: 564,899

[22] Filed: Aug. 8, 1990

[51] Int. Cl.[5] ..... E06B 9/30

[52] U.S. Cl. ..... 160/33; 160/35; 160/202

[58] Field of Search ..... 160/33, 32, 35, 36, 160/201, 236, 193, 197, 202, 222, 223

[56] References Cited

U.S. PATENT DOCUMENTS

| | | | |
|---|---|---|---|
| 1,886,105 | 11/1932 | Julin | 160/33 |
| 2,409,037 | 10/1946 | Guth | 160/33 |
| 2,559,005 | 7/1951 | Brown et al. | 160/33 |
| 2,897,886 | 8/1959 | Pistelli | 160/33 |
| 3,000,437 | 9/1961 | Bennett | 160/33 |
| 4,068,699 | 1/1978 | Tucker | 160/33 |
| 4,139,042 | 2/1979 | Watanabe et al. | 160/36 |
| 4,379,478 | 4/1983 | Lichy | 160/35 |
| 4,662,420 | 5/1987 | Hirao | 160/32 |

FOREIGN PATENT DOCUMENTS

| | | | |
|---|---|---|---|
| 0507694 | 11/1954 | Canada | 160/33 |
| 0400957 | 6/1909 | Fed. Rep. of Germany | 160/33 |
| 0212568 | 8/1909 | Fed. Rep. of Germany | 160/33 |
| 0535570 | 10/1931 | Fed. Rep. of Germany | 160/32 |
| 2752432 | 6/1979 | Fed. Rep. of Germany | 160/35 |
| 1303251 | 7/1962 | France | 160/36 |

*Primary Examiner*—Blair M. Johnson

*Attorney, Agent, or Firm*—Jordan and Hamburg

[57] ABSTRACT

A shutter assembly which requires minimal storing space substantially comprises a) a plurality of transparent or glass slats which form a shutter by being vertically suspended one after another, b) a storage case storing the slats in a stacked condition, the storage case being mounted on an upper part of an entrance of a building, c) a plurality of slat connecting devices each of which perpendicularly connects the bottom end of any succeeding slat to the upper end of any preceding slat, and d) brake means for applying braking force onto any one of the slats for enabling the shutter to stop at any desired height from the floor of the building. Accordingly, the shutter can be automatically stopped at any desired position from the ground or floor level thus assuring the safety of the user.

3 Claims, 8 Drawing Sheets

SHUTTER ASSEMBLY

BACKGROUND OF THE INVENTION

This invention relates to a shutter assembly used for doors of various building including garages and shops, and more particularly to a type of shutter which can be automatically stopped at any desired position above the floor or ground level.

In the prior art, a shutter assembly which includes horizontally disposed sections hinged along their horizontal edges and pivotally mounted at their ends, required extensive tracks which are dog-legged overhead back onto the ceiling of the building to accommodate the fully extended shutter after it was raised. Accordingly, the shutter required a large shutter storing space at the ceiling. Furthermore, it is difficult to make this conventional shutter stop at a desired elevated position such as a half-opened position above the floor or ground level.

Accordingly, it is an object of the present invention to provide a shutter assembly which can overcome the above defects of the conventional shutter assembly, wherein the shutter storing space at the ceiling can be minimized.

It is another object of the present invention to provide a shutter assembly which has transparent slats through which the inside of the shop can be observed whereby robbery is effectively prevented and the pedestrians can see the shop's merchandise displays even at night provided that the shop is lit.

It is still another object of the present invention to provide a shutter which has slats made of glass which can be easily broken at the time of fire so that smoke can be expelled from the shop without impediment.

It is a further object of the present invention to provide a shutter which has brake means so that the shutter can be stopped at any desired position from the ground or floor level, whereby safety at the time of opening or closing the shutter can be assured.

SUMMARY OF INVENTION

In summary, the present invention is a shutter assembly which comprises a) a plurality of slats which form a shutter by being vertically suspended one after another, b) a storage case storing the slats in a stacked condition, the storage case being mounted on an upper part of an entrance of a building, c) a plurality of slat connecting devices each of which perpendicularly connects the bottom end of any succeeding slat to the upper end of any preceding slat, and preferably d) brake means for applying braking force onto any one of the slats for enabling the shutter to stop at any desired height from the floor of the building.

PREFERRED EMBODIMENT OF THE INVENTION

An embodiment of this invention will be described in detail in view of the attached drawings.

Figure 1:
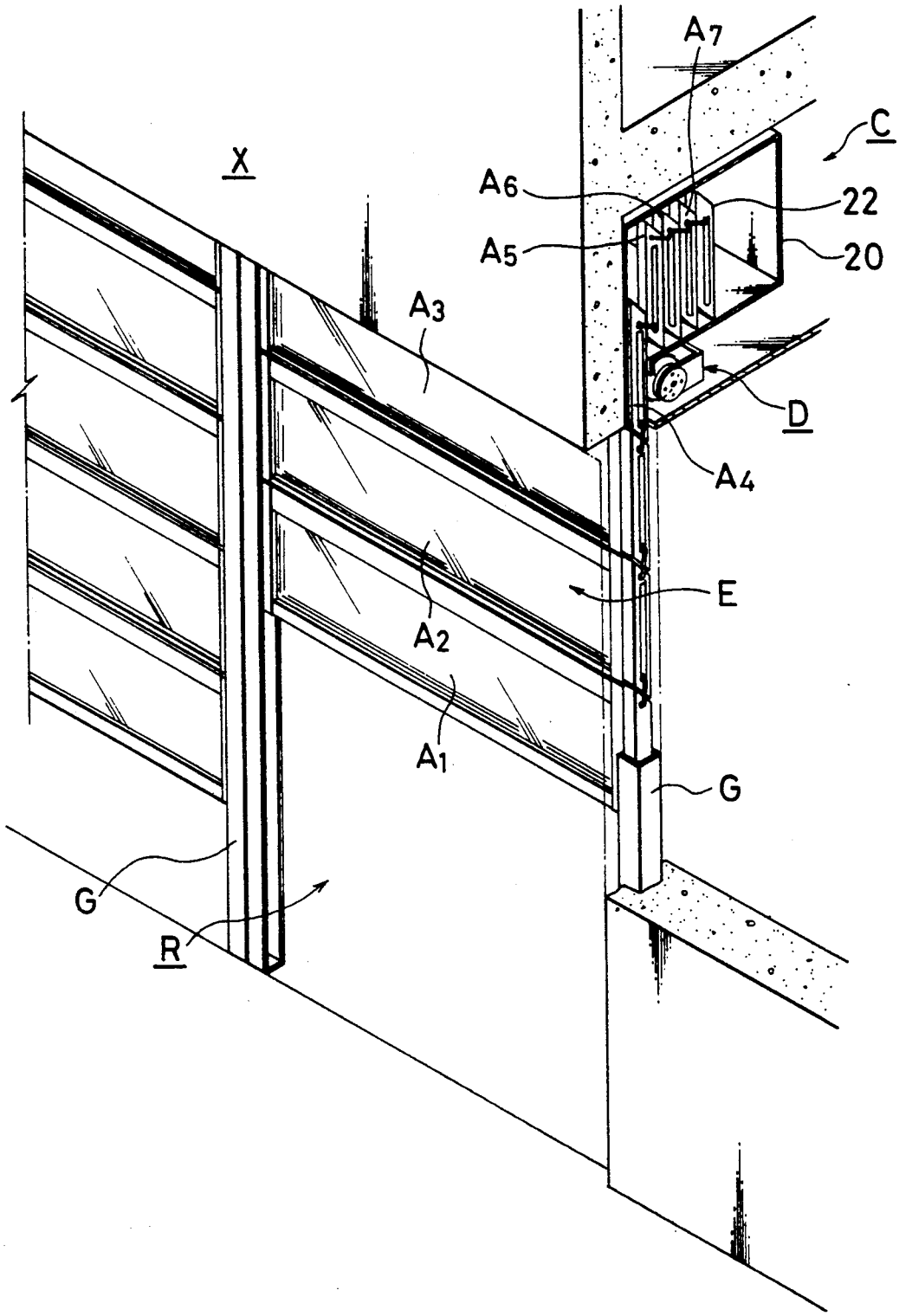
FIG. 1 is a perspective view of the shutter assembly of this invention.
Figure 2:
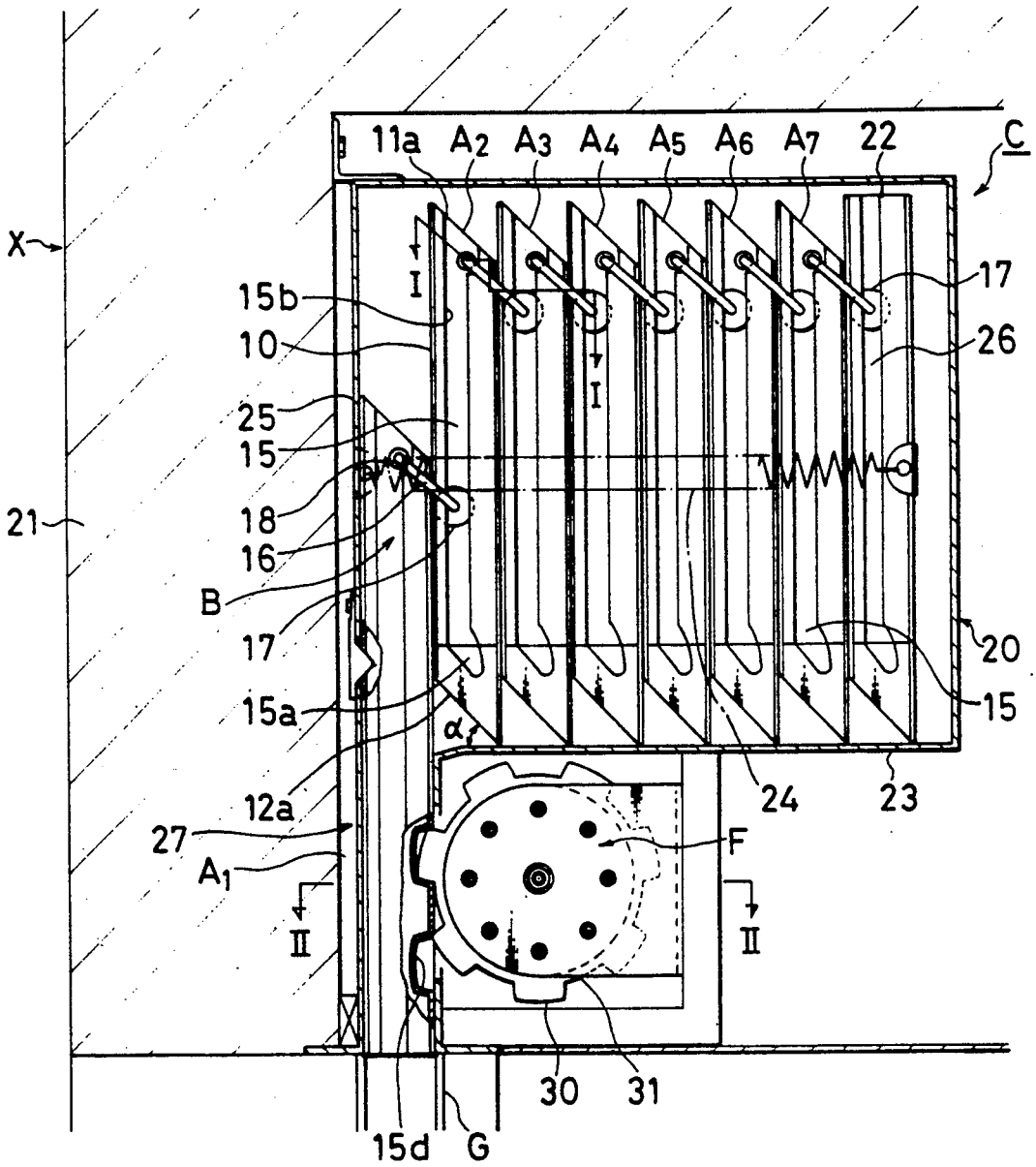
FIG. 2 is an enlarged cross sectional view of the storage case.

In FIGS. 1 and 2, a shutter assembly of this invention is shown and such a shutter assembly substantially comprises a plurality of slats $A_1$ to $A_7$, a plurality of slat connecting devices B connecting the slats $A_1$ to $A_7$ in series to form a shutter E at an entrance R of a building X, a storage device C supporting and storing the slats $A_1$ to $A_7$ therein when not in use and releasing the slats $A_1$ to $A_7$ to be extended downwardly in a shutter closing operation, and a brake device D for applying a braking force onto any one of the slats for enabling the shutter E to stop at any desired height from the floor of the building X.

The construction of respective devices $A_1$ to $A_7$, B, C, D, and E of the above-mentioned shutter assembly is explained hereinafter in detail.

Figure 4:
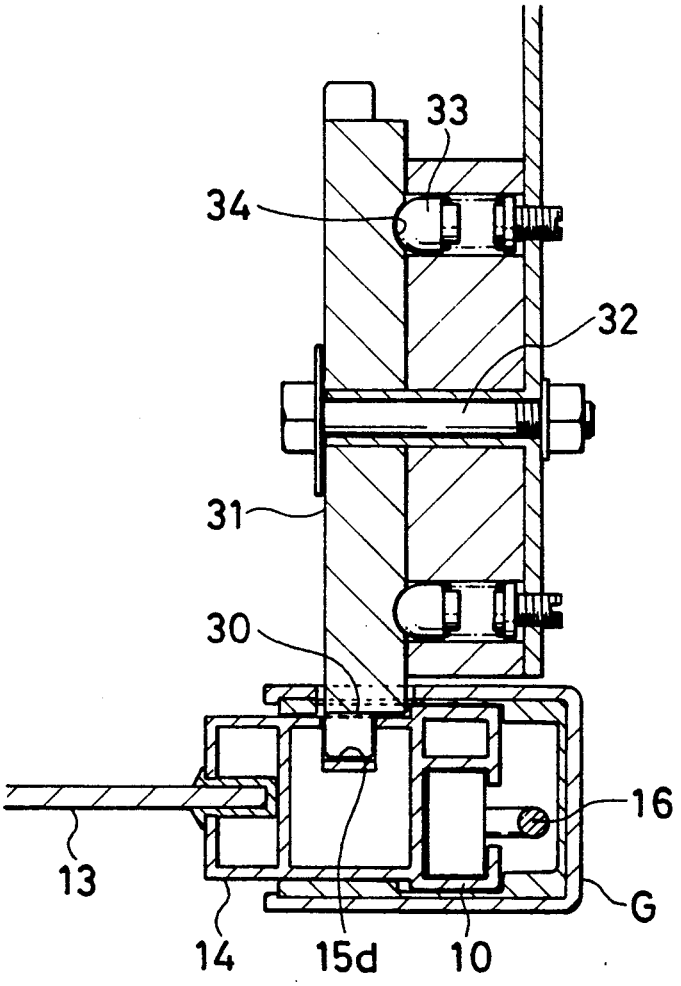
FIG. 4 is a cross sectional view of FIG. 2 taken along the line II—II of FIG. 2.
Figure 4A:
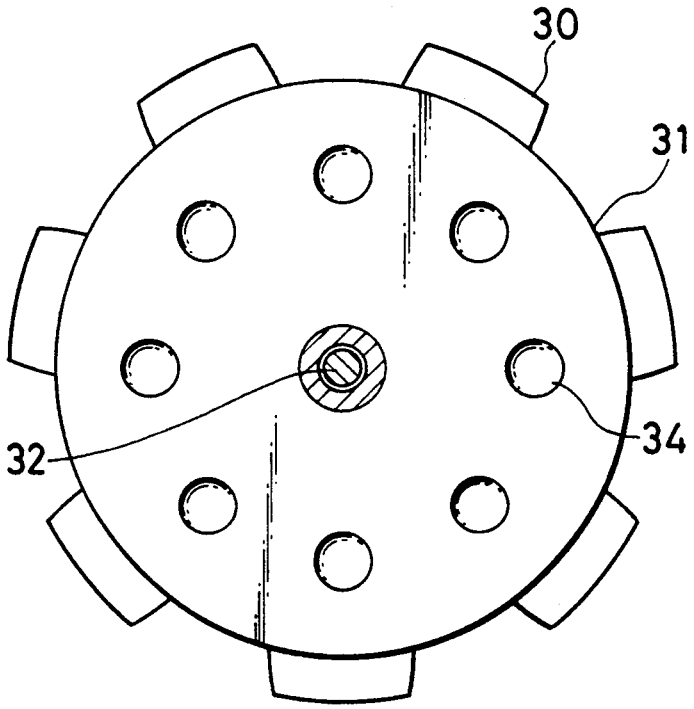
FIG. 4A is a plan view of the gear wheel which forms a part of the brake device.
Figure 5:
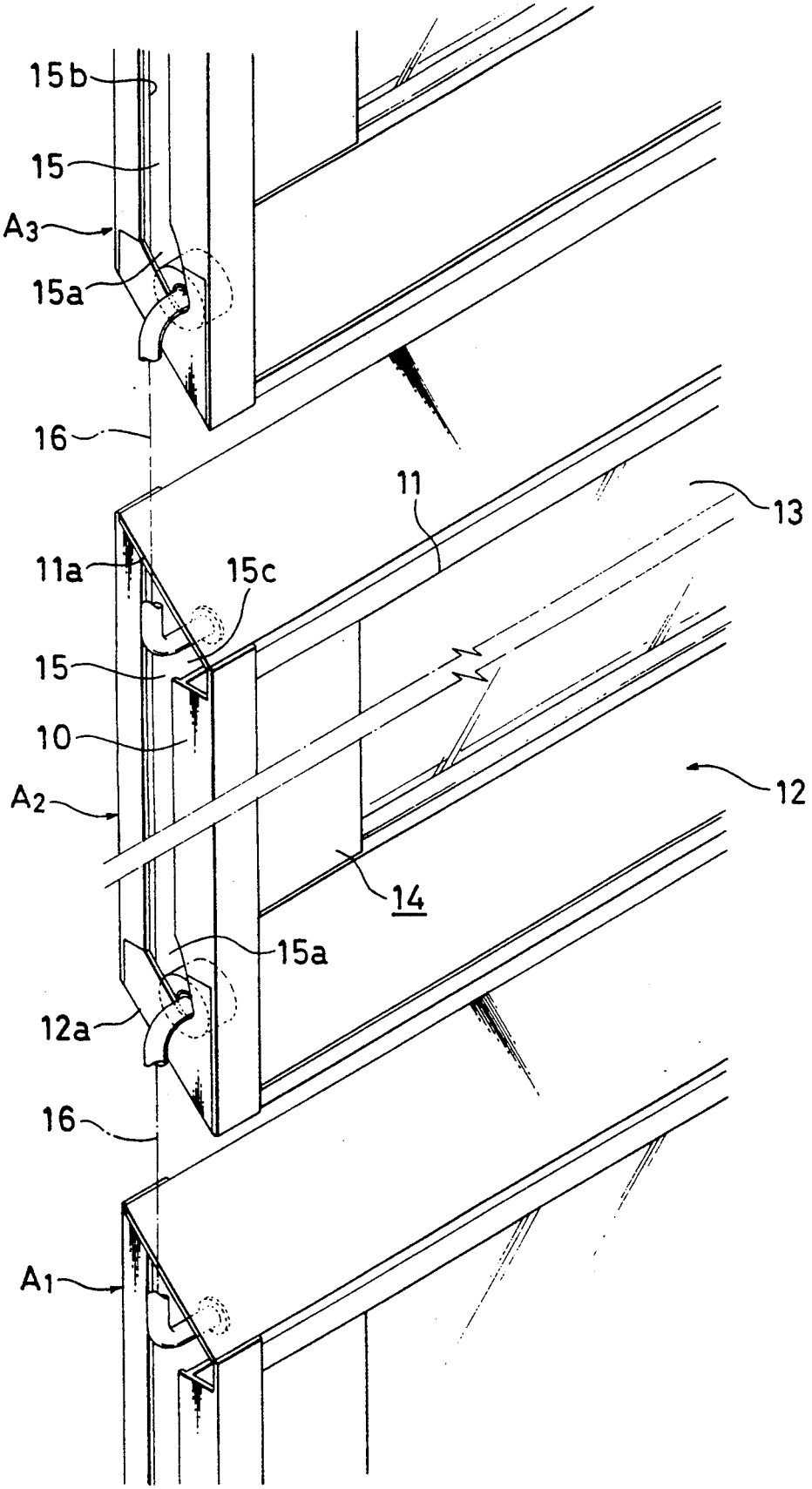
FIG. 5 is a schematic view of a plurality of slats which are extended to be formed into a shutter construction.

As shown in FIG. 1, FIG. 4 and FIG. 5, each slat $A_1$, $A_2$ . . . $A_7$ comprises a pair of parallelly-spaced-apart longitudinal slat sections 10, 10 and a pair of parallelly-spaced-apart lateral slat sections 11, 12 to form a laterally elongated frame. While such a frame is made of aluminum or steel, a pane 13 which may be preferably made of transparent glass is encased in the frame. The pane 13 is further firmly supported by a pair of width adjustment portions 14, 14.

For making the stacking of the slats $A_1$, $A_2$, . . . $A_7$ easy, the upper and lower lateral slat sections 11, 12 are inclined in the same direction with a same inclination angle $\alpha$ to form upper and lower inclined surfaces 11*a*, 12*a*.

Furthermore, each preceding slat (for example, $A_1$ in FIG. 2) has a portion thereof which slidably come into contact with the succeeding slat $A_2$. To be more specific, as shown in FIG. 2, both longitudinal slat sections 10, 10 of the preceding slat $A_1$ slidably come into contact with both longitudinal slat sections 10, 10 of the succeeding slat $A_2$.

Accordingly, the preceding slat $A_1$ slides down along the succeeding slat $A_2$. In the same manner, all other remaining slats $A_3$ to $A_7$ also slide down one after another. Since all these slats $A_1$ to $A_7$ are connected in series by a plurality of slat connecting devices B which will be described later in detail, all the slats $A_1$ to $A_7$ are vertically aligned in series to form the complete shutter E although the shutter E is shown in a half-opened condition in FIG. 1.

Figure 3:
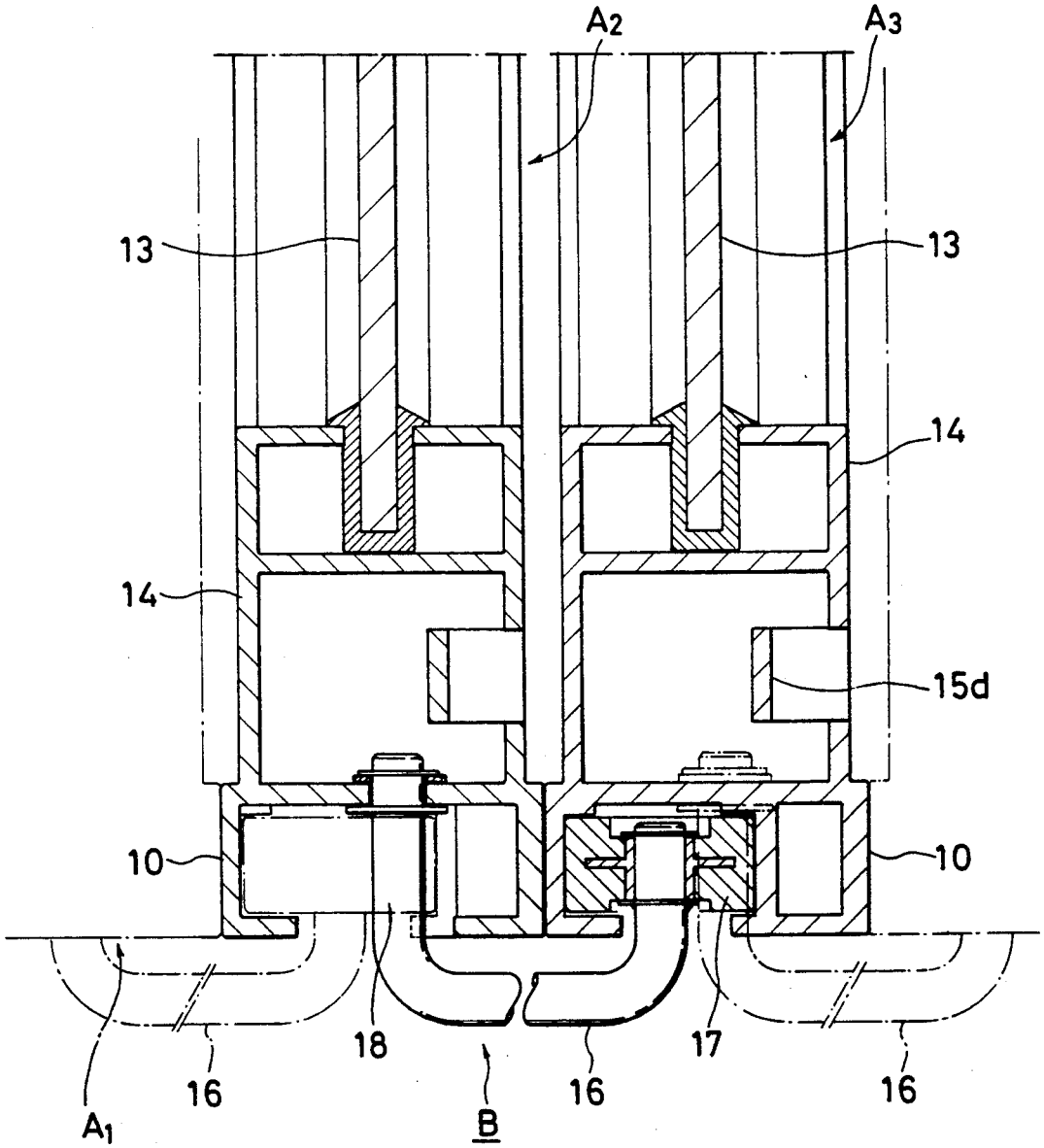
FIG. 3 is cross sectional view taken along the line I—I of FIG. 2.

As shown in FIG. 2 and FIG. 3, at side faces of the both longitudinal slat sections 10, 10 of each slat $A_1$, $A_2$, . . . a longitudinally elongated grooves 15, 15 are formed. Each groove 15 is provided with an inclined portion 15*a* at the lower end thereof and such an inclined portion 15*a* is inclined at the same angle as the lower inclined surfaces 12*a* of the lower lateral slat section 12.

As shown in FIG. 2 and FIG. 4, each slat $A_1$, $A_2$, . . .$A_7$ is also provided with recesses 15*d* at both lateral sides of the rear surface thereof and a plurality of teeth 30 of a wheel gear 31 which are described later are engaged with these recesses 15*d*.

The slat connecting devices B which connect slats A to each other have the following construction.

As shown in FIG. 1, FIG. 2, FIG. 3, FIG. 4 and FIG. 5 each slat connecting device B substantially comprises a U-shaped connector 16 and a support roller 17 which is rotatably mounted on one end of the U-shaped connector 16. The other end of the connector 16 is pivoted by a shaft 18 to the side of the upper end of the slat (for example $A_1$) which is disposed along the succeeding slat $A_2$.

In the shutter closing operation, the support roller 17 is, as shown in FIG. 2, slidably held inside the longitudinally elongated groove 15 of the succeeding slat $A_2$ and is capable of rolling downwardly along the rim 15*b* of the groove 15 corresponding to the relative slide-down movement of the preceding slat $A_1$ along a pair of vertical guide rails G, and finally, comes to rest in the inclined portion 15*a* of the longitudinally elongated groove 15. Subsequently, the further lowering of the preceding slat $A_1$ pulls the bottom end of the succeeding slat $A_2$ just above the upper end of the preceding slat $A_2$ by way of the slat connecting device B.

In this manner, each preceding slat is vertically suspended from the succeeding slat one after another by a plurality of slat connecting devices B along the entrance of the building, wherein each slat connecting device B is made of the U-shaped connector 16, the support roller 17 and the pivot shaft 18, respectively.

On the contrary, in the shutter opening operation, the support roller 17 of the succeeding slat $A_1$ is capable of rolling upwardly along the rim 15*b* of the groove 15 of the preceding slat $A_2$ corresponding to the relative slide-up movement of the succeeding slat $A_1$, and, finally, comes to rest adjacently below inclined portion 15*c* of the groove 15 which is positioned at the top of the longitudinal slat section 10 of the preceeding slat $A_2$.

Next, the storage device C is explained in view of the attached drawings.

As shown in FIG. 2, a storage case 20 is installed on the inner surface of a wall 21 of a building X and is located above the entrance of the building X.

In a fully opened condition, as shown in FIG. 2, all the slats $A_1$ to $A_9$ are stored in the storage case 20 in a stacked condition.

At the rear end of the storage case 20, a vertical support strut 22 rests on a slat support bottom plate 23 and a pair of springs 24 bridge between this vertical support strut 22 and a front wall 25 of the storage case 20.

Due to such a construction, all the stacked slats constantly receive the spring force in a direction to prevent the collapsing of the stacked slats.

The vertical support strut 22 is also provided with a longitudinal groove 26 which is similar in construction the longitudinally elongated grooves 15 of other slats and rotatably receives the support roller 17.

As shown in FIG. 2, the storage case 20 is provided with a bottom opening 27 at the front portion of the slat support bottom plate 23 and the slats $A_1$ to $A_7$ are elevated or lowered through this opening 27.

The brake device D for applying braking force onto any one of the slats for enabling the shutter E to stop at any desired height from the floor of the building is explained hereinafter in view of FIG. 2, FIG. 3, FIG. 4 and FIG. 4A.

As shown in FIG. 2, such a brake device D is substantially disposed just below the storage case 20.

The brake device D substantially comprises the wheel gear 31 thereof meshed the teeth 30 of which mesh with the recesses 15*d* of the slat, a horizontal shaft 32 which has the proximal end thereof secured to a frame of the brake device and rotatably supports the wheel gear 31 at the distal end thereof, and a plurality of spring-biased elements 33 which are urged into contact with the indentations 34 formed in a circumferentially spaced apart manner on one side of the wheel gear 31.

Due to such a construction, a considerable friction is exerted between the spring-biased elements 33 and the wheel gear 31 although the frictional force is less than the manual pulling force. Accordingly, in elevating or lowering the shutter E, owing to the presence of the friction, the shutter E can be stopped at any desired height from the floor of the building X.

The manner in which the shutter equipment of this invention is operated is hereinafter disclosed.

For closing the shutter E, the operator manually pulls down the lowermost slat A, and thereafter all the slats $A_1$ to $A_7$ are pulled out from the storage case 20 in the manner as described heretofore to completely shut the entrance R of the building X.

For opening the shutter E, the operator manually pulls up the lowermost slat $A_1$ and thereafter all the slats $A_1$ are pulled up and stored into the storage case 20 in the manner as described heretofore to completely open the entrance of the building X.

During the above shutter closing or opening operation, since friction is exerted by the brake device D, the shutter E can be stopped at any desired height from the floor of the building X. Accordingly, any accident during the shutter closing or opening operation can be effectively prevented.

Figure 6:
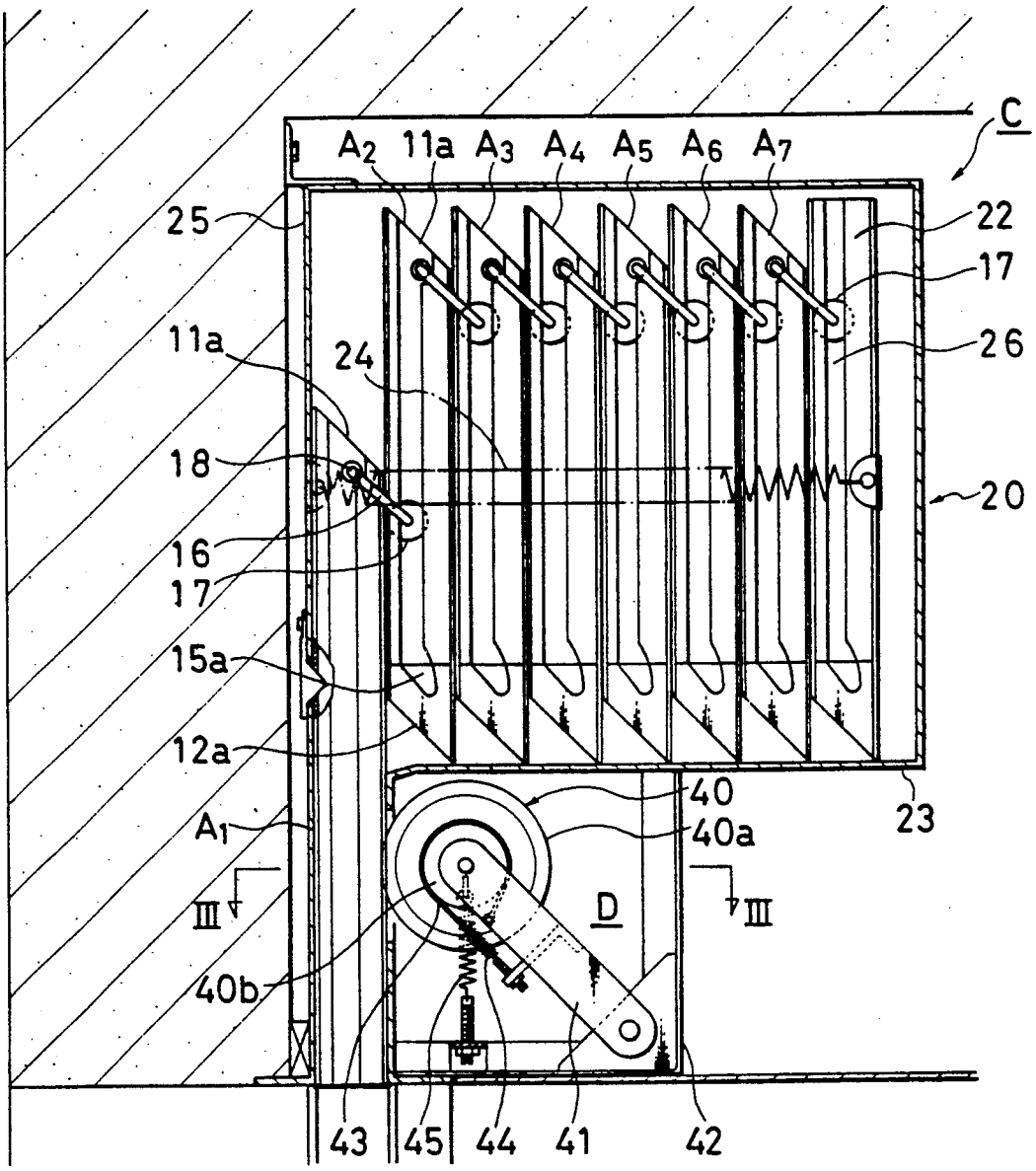
FIG. 6 is an enlarged cross sectional view of the storage case of the shutter assembly of the second embodiment.
Figure 7:
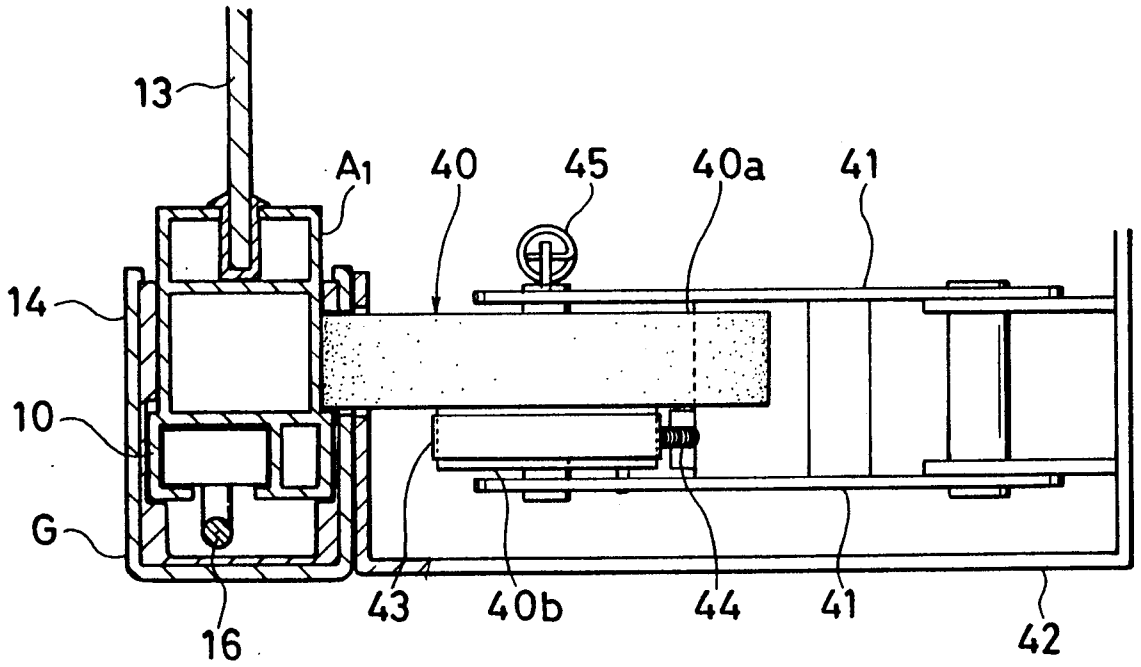
FIG. 7 is a cross sectional view of FIG. 6 taken along the line III—III of FIG. 6.

In FIG. 6 and FIG. 7, another embodiment of this invention is disclosed wherein the brake device D is substantially made of a stepped friction wheel 40.

Namely, the brake device D comprises the stepped friction wheel 40 made of a large wheel 40*a* and a small wheel 40*b*, a pivotal arm 41 which has the proximal end thereof pivotally connected to a frame 42 of the brake device D and rotatably supports the stepped friction wheel 40 at the distal end thereof, a brake band 43 tightly wound around the small wheel 40*b* with a spring 44, and a spring 45 which has one end connected to the distal end of the pivotal arm 41 and the other end connected to the frame 42.

Due to such a construction, the large wheel 40*a* of the stepped friction wheel 40 is constantly made to come into contact with the rear rough surface of the slats $A_1$ to $A_7$, while friction is exerted between the small wheel 40*b* of the stepped friction wheel 40 and the brake band 43.

Accordingly, during the above shutter closing or opening operation, since friction is exerted by the brake device D, the shutter E can be stopped at any desired height from the floor of the building X. Accordingly, any accident during the shutter closing or opening operation can be effectively prevented.

We claim:

1. A shutter assembly comprising:

(a) a plurality of slats which form a shutter by being vertically suspended one after another, each said slat having an upper and a lower lateral section, each said section being inclined in the same direction with the same inclination angle to form upper and lower inclined surfaces, each said slat having a pair of mutually parallel side sections connecting said upper and lower sections at opposed ends of said upper and lower sections, each of said side sections being provided with an elongated groove extending from adjacent the upper surface to adjacent the lower surface, each groove including a dogleg configuration having a straight upper portion and a straight lower portion, the lower portion being inclined relative to the upper portion to be substantially parallel to the upper and lower inclined surfaces, b) a storage case storing the slats in a stacked condition, the storage case being adapted to be mounted on an upper part of an entrance of a building, said storage case having a front portion adapted to be located substantially in a horizontal plane in which the entrance lies and a rear portion adapted to be located behind the plane in which the entrance lies, said storage case being provided with spring means for applying a spring force to all of said stacked slats in a direction toward the front portion of said storage case where an opening through which said slats are elevated or lowered is formed, c) a plurality of slat connecting devices each of which perpendicularly connects the bottom end of any succeeding slat to the upper end of any preceding slat, each said slat connecting device comprising a U-shaped connector which has one end pivotally connected to an upper end of said side surface of the preceding slat and another end being provided with a support roller, said support roller being slidably disposed in said groove of the succeeding slat and being receivable in said lower portion of the groove for the vertical suspending of the succeeding slat from the preceding slat, and d) brake means for applying braking force onto any one of said slats for enabling the shutter to stop at any desired height from the floor of the building, said brake means being a friction wheel engaging a surface of said slats.

2. A shutter assembly according to claim 1, wherein some of said slats are transparent.

3. A shutter assembly according to claim 2, wherein said transparent slats are each in the form of glass within a frame.

* * * * *